US006737014B2

(12) United States Patent
Davidkhanian et al.

(10) Patent No.: US 6,737,014 B2
(45) Date of Patent: May 18, 2004

(54) SLAG DETECTOR FOR MOLTEN STEEL TRANSFER OPERATIONS

(75) Inventors: Alex Davidkhanian, Mississauga (CA); Frank L. Kemeny, Lewiston, NY (US); Ali Langari, Toronto (CA); David I. Walker, Bolton (CA)

(73) Assignee: Nupro Corporation, Grand Island, NY (US)

( * ) Notice: Subject to any disclaimer, the term of this patent is extended or adjusted under 35 U.S.C. 154(b) by 215 days.

(21) Appl. No.: 09/803,607

(22) Filed: Mar. 9, 2001

(65) Prior Publication Data

US 2002/0057184 A1 May 16, 2002

(30) Foreign Application Priority Data

Mar. 17, 2000 (GB) ..... 0006609

(51) Int. Cl.[7] ..... C21B 7/12
(52) U.S. Cl. ..... 266/45; 266/90; 222/590
(58) Field of Search ..... 222/590, 591; 266/45, 236, 78, 90; 164/453

(56) References Cited

U.S. PATENT DOCUMENTS 5,042,700 A * 8/1991 Ardell et al. ..... 222/590
5,633,462 A * 5/1997 Heaslip et al. ..... 164/453

FOREIGN PATENT DOCUMENTS

JP 355097847 A * 7/1980 ..... 164/155.4
JP 406292960 A * 10/1994 ..... 164/453
JP 407164124 A * 6/1995

* cited by examiner

*Primary Examiner*—Scott Kastler
(74) *Attorney, Agent, or Firm*—Howard J Greenwald P.C.

(57) ABSTRACT

A method of determining disturbances when discharging molten metal from a metallurgical container having an outlet into a receiving container. In the first step of this process, one directly or indirectly detects mechanical vibrations caused by the discharge of molten metal through the outlet. Thereafter, a second property is measured; the second property so measured varies during the discharge of molten metal from the first metallurgical container to the receiving container. Then, one calculates a sensitivity constant based upon the measuring of the second property. Thereafter, a comparison is made between the vibrations detected by the measuring device with a desired vibrational characteristic, wherein the desired vibrational characteristic is defined in part by the sensitivity constant; the comparison is analyzed to determine the existence of the disturbances within the outlet, and actions are then taken to cause the disturbance(s) to cease.

5 Claims, 2 Drawing Sheets

SLAG DETECTOR FOR MOLTEN STEEL TRANSFER OPERATIONS

CROSS-REFERENCE TO RELATED PATENT APPLICATION

This patent application claims priority based upon United Kingdom patent application No. 0006609.2, filed Mar. 17, 2000.

FIELD OF THE INVENTION

A process for determining the presence of a slag phase in molten steel.

BACKGROUND OF THE INVENTION

Steel making is considered a batch process. A unit of steel is melted or made with oxygen in a primary steelmaking vessel. The steel is then transferred to a ladle where it is alloyed and refined. Then the steel is transferred to a distribution vessel called a tundish from which it is distributed to one or more molds for solidification. In each of the batch vessels, a slag is present on the steel, comprised of liquid and solid oxides. The properties of the slag are quite different in each batch operation and it is not desirable to allow the transfer of the slag from one vessel to the next in the production sequence.

Slag from the primary steelmaking vessel should not be carried into the ladle, slag formed in the ladle should not be carried into the tundish, and slag from the tundish should not be carried into the molds. At the same time, it is desirable to maximize the yield of metal during transfer operations. Ideally, all the steel and none of the slag should be transferred from one batch operation to the next. Practically, this is not possible since slag and steel tend to form an emulsion or mixture, particularly near the end of a transfer operation. In that case, either some steel must be left untransferred, or some slag must be transferred to the next operation. An object of the present invention is to provide the operator with a tool that will minimize the duration of two phase flow, and to help him to choose by grade the optimum condition for steel retention and slag transfer.

It is known that the degree of mixing of slag and steel during a transfer operation increases with the rate of steel flow. At high flow rates, a vortex may develop well before the end of the transfer operation. In that case, steel and slag may flow together for some time, causing an unacceptable amount of slag transfer. It is the object of steel transfer operations to maintain flow conditions that prevent the mixing and co-transfer of steel and slag. An object of the present invention is to indicate the onset of a vortex and to cause a change in the transfer operation to dissipate the vortex, either automatically or by informing the operator of a recommended course of action.

In the prevention of slag transfer from one vessel to the next, detection of slag flow is important. In many cases, the detection of slag flow is visual and after the fact. For example, in the tapping of steel from an oxygen steel making vessel, the operator will watch the tap stream and the surface of steel in the ladle for indications of slag flow. A significant amount of slag flow causes the stream to brighten and flare due to the higher emissivity and lower surface tension of slag in relation to steel. Also, the lower density of slag causes it to flow across the surface of the steel in the ladle whereas the steel stream penetrates the surface. These indications cause the operator to stop the transfer operation to prevent the further flow of slag into the ladle, but this is usually after significant slag volume has transferred from the steel making vessel into the ladle. The operators vary in level of skill, experience, and attention to detail, causing the amount of slag carry-over to be quite variable from heat to heat. It is therefore desirable to have an operator independent system that can detect the onset of slag flow during the furnace tapping sequence and cause the modification or end of the tapping sequence to minimize the inflow of slag to the ladle.

In another example, when teeming steel from the ladle to the tundish, the operator may watch the pour box area of the tundish for signs of slag flow, such as a brightening of the slag surface around the pouring tube, or a welling up of slag around the pouring tube. Upon seeing these signs, the operator will cause the end of the teeming operation to prevent further flow of slag. Once again, significant slag flow from ladle to tundish may have occurred by that time.

Several aids have been developed to detect slag flow from the ladle. One is based on the difference in conductivity between slag and steel and a resistance is continuously measured between two contact points within the nozzle. This method cannot detect vortexing which often precedes slag flow. Also this method fails if the steel fails to contact one of the probes. Additionally, this method fails if the slag flow is in the center of the stream, allowing the steel to contact both probes and the slag to go undetected.

U.S. Pat. No. 4,140,300 of Gruner et al teaches a method of slag detection that monitors the radiation intensity of the stream of steel flowing through a discharge tube. A lateral side duct is inserted in the ladle shroud, or discharge tube, through which the steel stream can be observed. A change in radiation intensity signals the onset of slag flow. This method is intrusive and requires side duct modification for each shroud, so it has not found acceptance. Additionally, slag flow through the center of the steel stream would go undetected.

Another method of slag detection relies on an indirect method of conductivity measurement using a magnetic field. An electromagnetic coil is placed around the flowing stream of steel. When slag begins to flow, the field properties are changed by the lower conductivity of the stream. The percentage of high conductivity to low conductivity stream area is set at a predetermined rate; and, when this falls below a given threshold, then an alarm signals the operator to shut the ladle stream. Alternatively, the ladle stream can be caused to automatically shut off when the given threshold value is reached. A disadvantage of this method is that vortical flow is not detected. Slag may form only a small percentage of the area of a vortexing stream, and this may not be enough to trigger the alarm to shut the ladle. A further disadvantage of this method is that the electromagnetic coils must be embedded into the refractory bottom of each ladle. These coils require periodic replacement and are a costly maintenance item. Replacement of a damaged coil is usually done when a ladle is scheduled to be relined with new refractory. Until that time, a ladle may go without slag detection ability for several batches of steel.

Yet another method of slag detection relies on the operator's ability to detect a difference in the vibration of a ladle shroud as slag flow begins. Steel has about twice the density of slag, and it causes the ladle shroud to vibrate significantly as it flows from the ladle into the tundish. This vibration tends to increase in strength during vortexing and decrease in strength during slag flow. Thus, a skilled operator can place a hand on the ladle shroud manipulator arm and sense the vibration during the latter part of a ladle pouring operation. The vibration will abruptly diminish as slag begins to flow through the shroud, at which time the operator causes the termination of the ladle draining operation. A vortex is more difficult to detect by hand, but a skilled operator may also sometimes detect the onset of vortexing flow and may cause the termination of the ladle draining operation at that point. While this method of slag detection is somewhat effective, it relies greatly on the skill and attentiveness of the operator and is thus inconsistent. Also, the operator does not have the ability to discern the various vibration frequencies associated with operations and activities around the casting machine. Some of these may influence his ability to accurately detect slag. In addition, the operator is influenced by his knowledge of approximate weight of steel left in the ladle. His level of sensitivity in slag detection may be low if he perceives that a significant amount of steel remains, and he may miss the early onset of slag. Conversely, his level of sensitivity may be heightened if he perceives that the ladle is almost empty, and he may terminate the pouring operation leaving a significant amount of steel in the ladle.

Instrumentation of the above method of vibration slag detection has been reported in the technical literature in papers from the BHP and NKK steel companies and in the patent literature. In each reported case, an accelerometer was used as a vibration transducer to continuously measure the vibration of the ladle shroud, the shroud manipulator arm or the tundish. In Japanese patent document 58-13455 (January, 1983), there is disclosed monitored vibration of the tundish during steel teeming. The amplified and filtered signal was monitored for a sudden increase and then drop in the amplitude, which signified the onset of slag flow and caused the steel teeming operation to be terminated. The sensitivity of the instrument was increased by also monitoring the rate of change of vibration amplitude with time. K. Yamamoto (Japan 58-13464, January 1983) teaches monitoring the vibration of the ladle shroud to determine the onset of slag flow and automatically terminate teeming. As is the case with the tundish, the shroud vibration amplitude increases with vortexing and decreases with slag flow. In another patent document (Japan Kokai 60-148652, August 1985), there is taught the use of a microphone to monitor the sound of steel flowing through the shroud. The onset of slag flow is marked by a decrease in the sound amplitude. One skilled in the art will realize that sound is, in fact, vibration and the concept is the same as that described in the previously mentioned prior art. The transducer to measure sound may be a piezoelectric accelerometer, a microphone, a Doppler laser device, or any other means that can quantify vibration intensity as a function of time.

BHP Steel in Australia reported using analog signal conditioning to filter out low frequency noise associated with crane movements and other background vibrations. The signal to noise ratio was also improved with analog signal conditioning. They measured vibration amplitude and output the signal using an analog meter. The onset of slag due to vortexing was noted by a marked increase in vibration amplitude. The signal dropped off dramatically after slag flowed through the nozzle. The system sounded a threshold alarm when vortexing reached a critical level, but the operators actually learned to read the analog output and take action based on the vibration pattern observed just before the alarm. The system was reported to be better than visual slag detection or manual vibration detection. It also required less maintenance than electromagnetic methods and was considerably less expensive. However, several disadvantages were noted. Firstly, the flow control slide gate had to be set to a low flow level near the end of a transfer operation which caused reduced metal level in the tundish. Secondly, the slide gate could not be moved after it was set in detection mode. Finally, in conditions where a vortex did not form prior to slag flow, the operator reaction was too slow in closing the teeming stream and significant slag flow into the tundish could occur.

U.S. Pat. No. 5,042,700 teaches the use of a piezoelectric accelerometer to monitor the vibration of the ladle shroud that is caused by steel flowing through it. It is disclosed that vortexing flow causes an increase in vibration amplitude and that the onset of slag flow causes a decrease in vibration amplitude. The vibration signal is continuously compared to a desired signal and action is taken when the vortexing or slag is indicated by the deviation from the desired signal. Additionally, Ardell teaches that a gradual decrease in vibration amplitude over time without adjustment of any flow control device indicates a blockage of the flow channel, such as might occur with the accretion of aluminum oxide particles within the nozzle. The inventors then address the means to clear such a blockage, such as by a burst of argon through the shroud.

In U.S. Pat. No. 5,633,462, it is disclosed that a background vibration signature should be recorded as a comparative signal against which a real time signal is continuously compared. When the real time signal deviates significantly from the background signal, the teeming is caused to stop either by feedback to the flow control device or by alarming the operator. In fact, real time monitoring of vibration, as taught by the prior art, is a continuous comparison of a new amplitude signal to a previous amplitude signal.

It is an object of this invention to provide an improved process for detecting slag.

SUMMARY OF THE INVENTION

In accordance with this invention, there is provided a method, for determining the presence of a slag phase in molten steel being transferred in a teeming operation between originating and receiving metallurgical vessels, of the type wherein vibration transferred to structure involved in the transfer is monitored to detect the presence of a slag phase, or conditions conducive to the presence of such a phase, in steel being transferred, the monitored vibrations being processed to provide data used to assess actual or incipient passage of slag, and means operable to control the rate of and termination of teeming is controlled responsive to the data to terminate teeming; wherein parameters of data generated representing characteristics of the vibration are compared with threshold values to generate at least one signal indicative of actual or incipient passage of slag, and the threshold values are progressively adjusted responsive to data collected by monitoring plural parameters of the teeming operation selected from weight of the originating vessel, weight of the receiving vessel, condition of the means controlling teeming, and temperature of the molten steel.

BRIEF DESCRIPTION OF THE DRAWINGS

The invention will be described by reference to this specification and the drawings, in which like numerals refer to like elements, and in which.

DESCRIPTION OF THE PREFERRED EMBODIMENTS

Figure 1:
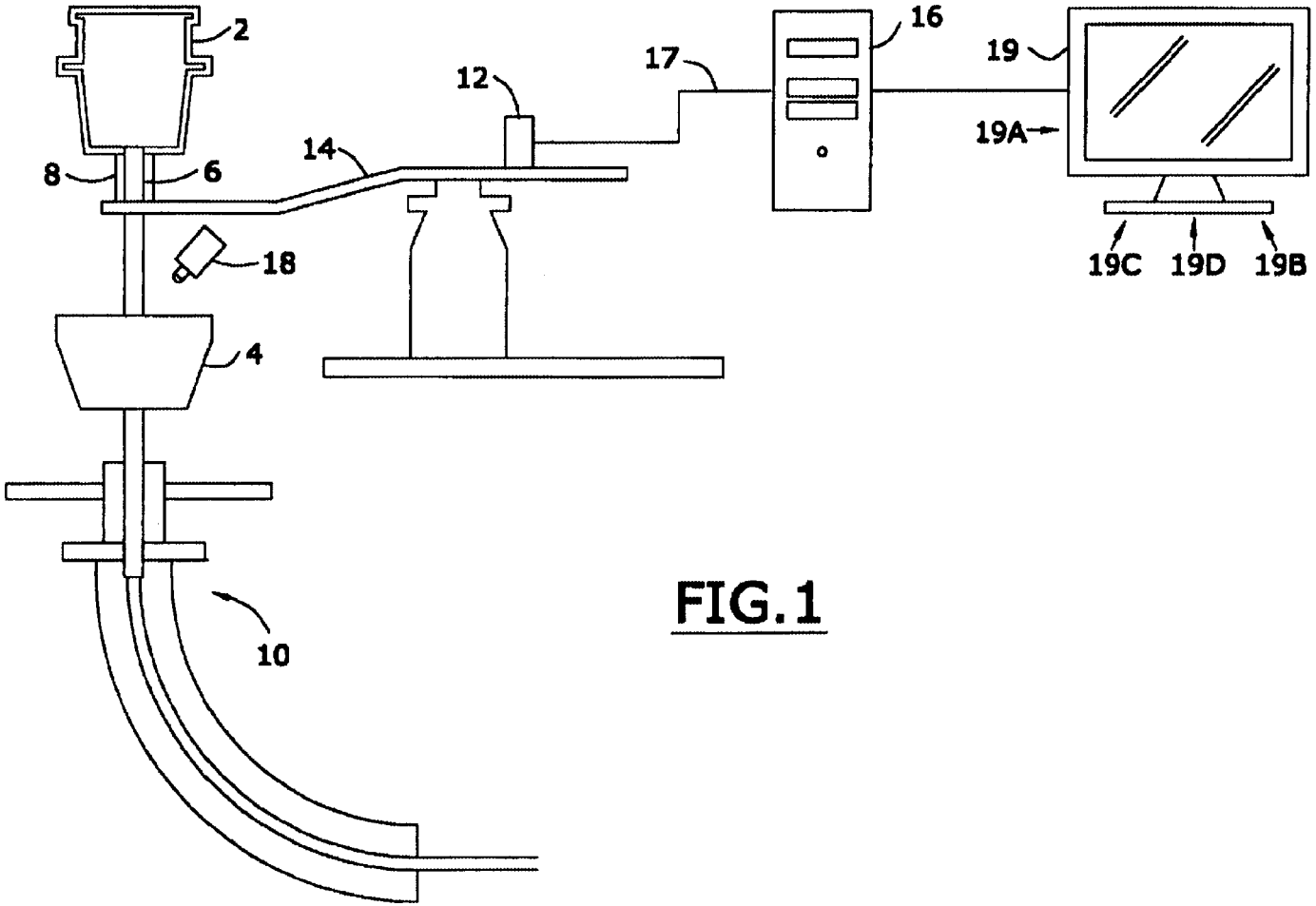
FIG. 1 is schematic diagram of components used in a steel transfer operation.

Applicants have discovered, in the slag monitoring process described above, that there is no need to record a previous signal, but only to compare in real time the current signal to the recent historical signal. Indeed, the recording of the historical signal is no longer relevant once a process change is effected, such as a slide gate movement, or a reduction in steel flow due to decreasing head or clogging of the nozzle.

The vibration of a ladle shroud due to steel flow may be characterized as chaotic. The steel can impact the shroud at many angles, and the flow is turbulent. Sometimes impacts on the shroud may cancel each other, causing a momentary lull in vibration intensity. Other times the vibration nodes may be additive, causing momentary peaks of vibration intensity. In the BHP system, the operator's brain is used as a smoothing or time average mechanism. These momentary disturbances are ignored, but more sustained changes in vibration are heeded as important. Any attempt to automate this process requires time averaging or smoothing of the vibration signal. This will slow response time to vortexing or slag flow.

The vibration signal for steel flow can also vary considerably from steel batch to steel batch, despite relatively similar conditions of teeming rate and duration. The condition of the flow control device, the amount and type of accretions deposited within the flow nozzle system, the morphology and chemistry of the oxide inclusions present within the flowing steel, the amount and chemistry of the slag layer above the steel, and other process parameters can significantly influence the vibration characteristics associated with steel flow. This has caused limitations in the usefulness of the described prior art, and slag may often pass undetected in the teeming operation.

It is the object of this invention to mitigate the difficulties and uncertainties of slag detection during steel flow. It is a further object of the present invention to reduce the lag in response due to the time averaging requirement discussed above.

In our invention, the known technique of vibration monitoring is used to detect the onset of vortexing and slag flow. While the process is made quicker and more accurate by the use of high speed data acquisition, digital signal processing and filtering, and smoothing of the signal is applied to eliminate momentary chaotic amplitude variations, performance is improved by integrating the signal in the frequency domain at least within a range of frequencies characteristic of slag flow, and preferably also within a range of frequencies characteristic of vortexing, which is an indicator of incipient slag flow. The sensitivity constants used to trigger the end of teeming are continuously modified in accordance with operating parameters such as trends in ladle weight, tundish weight, gate movements and steel temperature. These parameters vary greatly near the end of a teeming operation, so they are used in a neural network analysis to increase the detection sensitivity of our device. This reduces the likelihood of false alarm as well as increases the likelihood of timely slag detection. Finally, the method of the invention optionally employs a real time digital image of the metal being transferred, for example, the surface of the tundish around the pouring tube, so that in the unlikely event that slag flow goes undetected, it can be detected by the real time image and teeming will be caused to terminate. In addition, gate movements can be detected in the event that this information is not otherwise available.

The present invention makes use of several principles to achieve the most expedient and accurate detection of slag flow within or following steel flow through a teeming nozzle. The method is applicable to teeming operations from 1) furnace to ladle, 2) ladle to tundish, 3) tundish to mold, or 4) any other liquid transfer operation where two phase flow is possible through a teeming orifice. By way of example, the present invention will be described with reference to teeming steel from a ladle 2 to a tundish 4 associated with continuous casting apparatus 10, through a refractory pouring tube 6 where the flow rate is controlled by a flow control valve 8 such as a slide gate valve.

Figure 2:
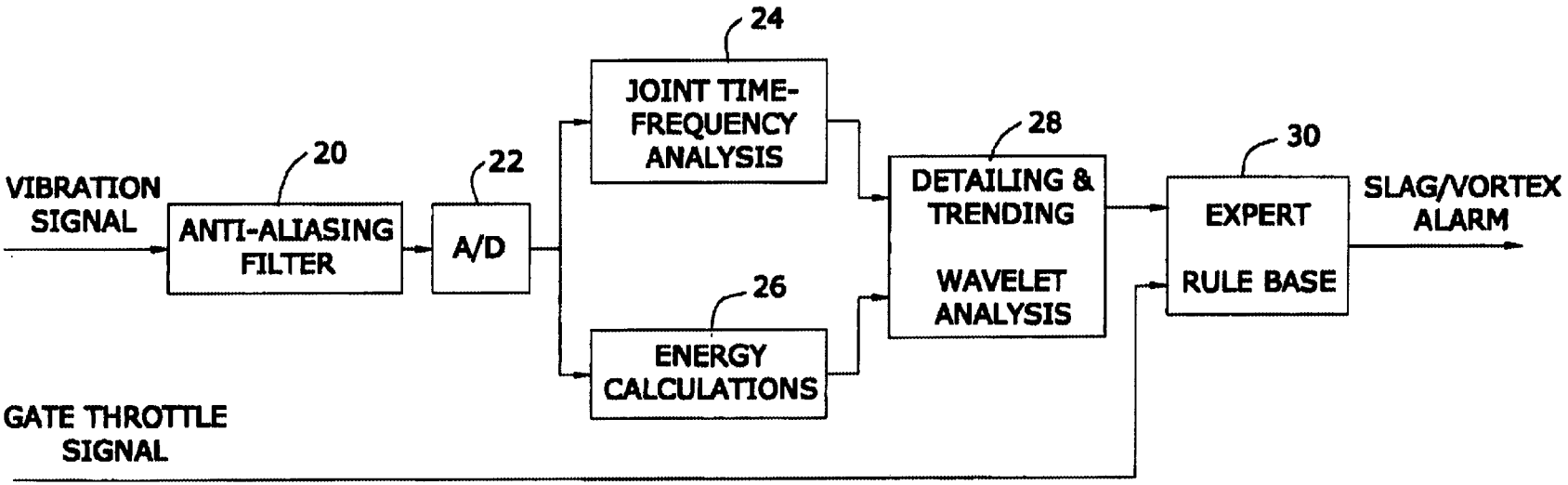
FIG. 2 is a flow diagram of an associated control system.

The primary detection method is by analysis of the vibration of the pouring tube (shroud) during the teeming operation. A vibration measuring transducer 12 monitors the shroud vibration. Suitable transducers include seismic piezoelectric accelerometer, capacitance accelerometer, or Doppler lasers set up to monitor vibration. In a preferred embodiment, a piezoelectric accelerometer with integral signal amplifier is mounted to the shroud manipulator arm 14 which is in communication with the ladle shroud. The signal from the accelerometer is transmitted to a data acquisition system within the processing computer 16. Fast Fourier Transform (FFT) operations are applied to the discrete time based vibration signal as collected and digitized by the high speed data acquisition system, the operation of which is illustrated by FIG. 2. An anti-aliasing filter 20 and over-sampling digitization in A/D converter 22 are applied to minimize error. A frequency spectrum analyzer 24 identifies relevant vibration frequency ranges, one range being characteristic of steel flow and an optional second range being characteristic of slag flow. An integration is performed in the frequency domain of the signals within each of these ranges to yield a real time amplitude or energy of vibration characteristic of the teeming operation (block 26). These amplitudes are then smoothed over a predetermined time period to provide trend signals (block 28), using a time constant. A rising trend in the amplitude of the steel flow signal indicates the onset of vortexing. A falling trend in the amplitude of the steel flow signal and/or the rise in the amplitude of the slag flow signal indicates the flow of slag through the shroud. It should be understood that it is not essential to isolate and monitor a characteristic vibration signal associated with slag flow, but that this is a desirable redundant feature in some cases. A sensitivity constant is used to set the alarm points for vortexing and slag flow. A high level of sensitivity may cause premature shut off and yield loss in some cases. A low level of sensitivity may allow an undesirable amount of slag to enter the tundish. Thus the time constant and sensitivity constant are continuously varied during the teeming operation based on the monitoring of relevant casting parameters, utilizing an expert rule base 30.

Some grades of steel are manufactured in a way that results in a viscous low density slag on the surface of the ladle. In these cases there is an abrupt decrease in vibration amplitude in the steel flow frequency range when slag begins to flow through the teeming nozzle, and shut off sensitivity and time constants are set accordingly. In other grades, there is a higher density slag of lower viscosity that is present on the surface of the steel in the ladle. In these cases, both steel and slag may flow together through the teeming nozzle for a substantial period of time, so the change in vibration amplitude is not so abrupt, and shut off sensitivity and time constants must be set accordingly, taking into account the relative importance of yield loss and steel quality requirements.

During the teeming of steel from the ladle to the tundish it is desirable to maintain the tundish at a constant head level. Most casting operations employ tundish level control. If the tundish weight falls outside a predetermined range, the slide gate valve is adjusted to adjust the rate of steel flow from the ladle, and thus bring the tundish weight back within the desirable range. Thus as the ladle head decreases and the steel velocity drops, the slide gate valve is opened to maintain the desired flow rate. Since the velocity of steel flowing through the slide gate valve is related to the square root of the head of steel in the ladle, the slide gate valve movements to maintain flow become more frequent near the end of the teeming operation. It is observed that near the end of the teeming operation, the derivative of steel weight in the ladle with time becomes more variable, the tundish weight becomes more variable, and the gate movements become more frequent. In addition, the steel temperature drops at a faster rate as the surface area to volume ratio increases and the radiation view factor for heat loss increases. It is also observed, in those cases where tundish steel temperature is measured continuously, that the rate of change in temperature with time increases just before the end of a heat. The monitoring of the above mentioned parameters in itself could provide quite accurate indication of the end of steel flow from a ladle, but in the present invention these parameters are used to continuously adjust the time constant and detection constant used in the sensitivity adjustment of the vibration based slag and vortex detector.

The description so far describes a principal feature of the present invention, but optionally an additional measure of slag detection can be employed. In those rare cases where two phase flow goes undetected or is difficult to detect by means described above, there is a visible indication of slag flow in the pour box area of the tundish around the shroud entry point. Slag is about half as dense as steel, so any slag floats immediately as it enters the tundish. The floating slag disturbs the surface layer on the tundish around the pouring tube, sometimes to the point of breaking the slag or flux on the surface. Thus in a preferred embodiment of the present invention, a real time image is taken of the surface of the tundish near the entry point of the pouring tube or steel stream, by camera 18. Image processing is employed in the computer 16 to monitor surface movement and surface brightness. Uniform surface movement is interpreted as tundish level change, but random movement is interpreted as flow disturbance, probably due to slag flow or vortexing. A rapid increase in brightness is interpreted as slag carryover. This back-up system can be used to cause the termination of teeming in the unlikely event that the primary slag detection did not occur. This method can be used alone to indicate the onset of slag flow if there is component failure in the vibration detection system. Furthermore, it can be used to detect movements of the slide gate valve in the absence of independent sensing means for the purpose. In those cases where some small but consistent amount of slag entry into the tundish from the ladle is desirable, such as for the purpose of maximizing yield, this method of image acquisition and processing may be used as a stand-alone low cost slag detection device.

In some cases, steel is teemed without an encasing shroud, such as from a furnace into a ladle. The camera can, in this case, be aligned so that the image can be used to monitor stream geometry and stream surface radiation intensity. The relative diameter of flowing stream at the exit point is an indication of the orifice or tap hole size from which it is flowing. Tap hole diameter increases with the number of teeming operations, so that the diameter of an old tap hole is substantially larger than that of a new tap hole, and the teeming rate is substantially higher. A higher teeming rate usually results in more slag flow throughout the teeming operation, a higher propensity to vortex formation, and a higher rate of slag flow following the last of the steel flow at the end of the teeming operation. The teeming steel stream typically has variable compactness during the teeming operation. The steel stream tends to break apart and flare if slag is also flowing with it, probably due to the reduction in surface tension and different viscosities of the two phases. Regardless of the mechanism, a flaring stream near the end of the teeming operation is an indication of two phase liquid flow or disrupted steel flow. The apparent intensity or brightness of slag is higher than that of steel in the teeming stream. The computer 16 digitizes the image taken by camera 18 and classifies the pixels according to brightness. The increase in brightness when slag flows in the teeming stream is an excellent indicator for the end of the teeming operation and is used to alarm the operator to shut off the teeming stream by closing a gate or changing the furnace angle so as to cease teeming.

In the visible range of the radiation spectrum, there is a significant increase in apparent brightness of the teeming stream when steel flow changes to slag flow. Operators have used this principle to indicate when to rotate the furnace and cause the end of the teaming operation. The abovementioned intensity difference increases in the infrared region of the spectrum. In a preferred embodiment, the camera 18 includes infrared pass filter to let only those wavelengths longer than about 700 nm through to the CCD array within camera 18.

This filtered image is digitized by image acquisition card in the computer 16 and the image is analyzed frame by frame to indicate the relative amounts of steel flow and slag flow within the teeming stream. When the teeming stream is substantially slag flow, an alarm is activated to alert the operator to end the teeming operation. An added advantage of the frame by frame analysis of relative amounts of steel flow and slag flow is that the total amount of slag that has flowed from the teeming vessel into the receiving vessel can be estimated. This is possible in those cases where the teeming rate is known or can be calculated.

The onset of vortexing is undesirable since it may cause the termination of the teeming operation before the steel is completely drained from the ladle. A yield loss is thus incurred. In the present invention, vortexing is detected and compared with the predicted end of steel flow from the ladle. In a preferred embodiment of the present invention, the end of teeming is predicted from the parameters measured for setting time constant and sensitivity constant adjustment, i.e., ladle weight derivative with time, tundish weight, gate movements and steel temperature can be compared to the time of onset of vortexing. If a vortex occurs substantially before the predicted end of teeming, vortex abatement can be effected. This may be accomplished by the momentary closure of the slide gate valve to stop steel flow and then the re-opening of the slide gate valve to continue steel flow without the vortex. The flowrate is thereafter kept lower to prevent recurrence of vortex formation. The slag detection sensitivity constant should be set to maximum, and automatic tundish level control should be disengaged. In this manner steel can be more completely drained from the ladle without significant slag flow. The tundish weight may drop during the procedure, but this is in most cases an acceptable trade for the additional yield.

Referring again to FIG. 1, the transducer 12 is preferably an amplified integrated circuit accelerometer 2 mounted to a ladle shroud manipulator arm 14, preferably on a radial axis with reference to the shroud.

The computer 16 with a data acquisition card and signal processing software is located in a remote location, and the signal from the accelerometer is transmitted to the computer by a shielded twisted pair cable 17. A display monitor 19 is provided.

Anti-aliasing and over sampling are applied to the signal (see block 20 of FIG. 2) to increase signal to noise ratio and to minimize error. FFT is applied to the signal in the time domain to yield an intensity vs. frequency plot of the vibration of the shroud at discrete intervals.

The range of frequency corresponding to shroud vibration due to steel flow is identified, and an integral is performed over this range for each time interval, yielding an intensity vs. time plot. The intensity vs. time plot is time averaged over several discrete measurements, the number of measurements being dictated by a time constant which is long during most of the teeming process, but becomes shorter as parameters indicate that little steel is left in the ladle. The resulting derivative is continuously monitored. A detection constant sets the upper and lower limits for this derivative. If this derivative climbs above the upper limit for a predetermined time period, then a vortex alarm is actuated. If this derivative falls below the lower limit for a predetermined time period, then a slag alarm is actuated.

The computer receives data from a data highway or programmable logic controller (PLC) from which it receives process information including: a) ladle weight, b) tundish weight, c) ladle slide gate movement, and d) tundish temperature, or equivalent information for other types of teeming operation.

The derivative of ladle weight with respect to time is monitored. Upper and lower setpoints for this derivative are preset during the first stages of the active slag detection period. As the teeming process progresses, this derivative deviates outside the set range, and the duration and amount of this deviation are applied to adjustment of a time constant factor and a detection constant factor.

The tundish weight with respect to time is monitored. Upper and lower setpoints for this weight are preset during the first stages of the active slag detection period. As the teeming process progresses, this weight may deviate outside the set range, and the duration and amount of this deviation are applied to a time constant factor and to a detection constant factor.

The number of ladle slide gate movements is monitored with respect to time. As the frequency of movements over time increases, the time constant factor and detection constant factor are changed accordingly.

The derivative of steel temperature in the tundish with respect to time is monitored continuously. As this derivative falls near the end of teeming, the time constant factor and detection constant factor are correspondingly adjusted.

The four preceding steps all apply changes to the time constant factor and detection constant factor as the teeming process progresses toward completion. These two factors are applied to the time constant and the detection constant which are used to set the sensitivity of reaction to changes in the integrated time averaged intensity vs. time plot. A neural network system is used in conjunction with the expert database 30 in a preferred embodiment to apply the process variables in the most effective manner.

The field of view of the camera 18 includes the area in the pour box near and around the ladle shroud insertion point. The digitized images are processed by image analysis software and compared in real time to previous images. Markers are identified by the software to indicate ladle shroud position, slag surface position and slag tundish interface position. Uniform movement of slag markers represents a change in the tundish surface level. Movement of the ladle shroud markers represents ladle gate movement. Non-uniform or random motion of the slag markers indicates flow disturbance in the pour box, probably due to slag flow into the tundish.

The intensity of the slag surface area is also monitored continuously. As the slag surface is broken, for example during slag flow into the tundish, the brightness increases. This is used as another indication of slag flow into the tundish. This back-up method is particularly useful when the primary detection method has failed due to equipment malfunction or process anomaly.

In the case of teeming without and encasing shroud, the steel stream intensity and shape may also be continuously monitored. As the teeming stream shape becomes erratic and variable, and as the apparent brightness of the stream increases, these signs are construed to indicate the change of steel flow to slag flow. The changes, when exceeding a predetermined threshold, are used to end the teeming operation either by alarming the operator or by automatic feed back to the teeming vessel PLC.

The operator interface in a preferred embodiment of the invention provides a display 19A of vibration intensity vs. time in real time on the monitor 19. Furthermore, a window 19B showing the real time digital image of the pour box is displayed on the monitor screen. Alarm displays 19C and 19D are also present, indicating vortexing or slag entrainment. The operator can observe these inputs and terminate the teeming operation at the appropriate moment. Alternatively, the vortex alarm may be used to trigger a vortex suppression procedure as previously described whereby the slide gate valve is automatically closed and then opened to a predetermined setpoint enabling teeming to continue until the slag alarm is triggered. The slide gate valve may be automatically closed on triggering of the slag alarm.

It should be realized that not all teeming operations include a device to shut of the flow of the teeming stream. In the case of teeming from a steel making vessel into a ladle, for example, it is often the case that the rotation angle of the furnace is used to start and stop the teeming operation. In this case, the slag alarm or indication will cause the PLC or furnace operator to rotate the furnace to a position that stops the flow of material from the vessel.

It should be realized that some flow of slag from the teeming vessel into the receiving vessel is often inevitable. The importance of maximum yield will often outweigh the importance of zero slag carry over. Nevertheless, in these cases it is useful to know just how much slag was carried over from the teeming vessel into the receiving vessel. Since the analysis and slag detection method of this invention is time based and involves the knowledge of process parameters that indicate teeming rate, it is possible to calculate the amount of slag that actually entered the receiving vessel in each case. This is particularly useful in those cases where chemical reactions are required to change the properties of the slag to match the requirements in the receiving vessel. An example of this is the iron oxide content of steel making slag that enters the ladle, the amount of which is important to know in order to add the correct amount of reducing agent to the slag to remove the detrimental iron oxide.

The amount of slag carried over from the teeming vessel to the receiving vessel is calculated by analysis of the vibration signal after the teeming operation is complete. The teeming rate is known and the time based vibration signal analysis indicates what percentage of the time and to what extent slag flow took place. In addition, in those cases where teeming occurs without a shroud, the image analysis of the teeming stream indicates what fraction of the teeming stream is slag in each time frame. This is done by digitizing the image and counting the fraction of pixels that exceed a threshold brightness level and normalizing with respect to total stream area in each frame. This is then integrated over all the frames to give the total amount of slag that was teemed into the receiving vessel.

As will be apparent, the process of this invention detects disturbances in the flow of molten metal through a discharge orifice. The term "disturbances," as used in this specification, is identical to the same term as used in the specification and claims of U.S. Pat. No. 5,042,700, the entire disclosure of which is hereby incorporated by reference into this specification. In particular, and by way of illustration and not limitation, the term disturbances includes slag flowing from the discharge orifice, the presence of a vortex within the discharge orifice, accretion formation within the discharge orifice, and the like.

In one preferred process of the invention, there is disclosed a method of determining disturbances when discharging molten metal from a first metallurgical container having an outlet into a receiving container, said method comprising the steps of:(a) directly or indirectly detecting mechanical vibrations caused by the discharge of molten metal through an outlet; (b) measuring a second property in addition to said mechanical vibrations, wherein said second property varies during the discharging of said molten metal from said first metallurgical container to said receiving container; (c) calculating a sensitivity constant based upon said measuring of said second property; (d) comparing said vibrations detected by said measuring device with a desired vibrational characteristic, wherein said desired vibrational characteristic is defined in part by said sensitivity constant; (e) analyzing said comparison to determine the existence of said disturbances within said outlet, wherein said detecting of mechanical vibrations, said measuring of said second property, said calculating of said sensitivity constant, and said comparing of said vibrations with a desired vibrational constant, are each conducted substantially simultaneously with each other; and (f) causing said disturbances within said outlet to cease. A controller monitors and directs the performance of some "simultaneous steps" used in this process. However, because computers perform operations sequentially, the performance of one such step may occur within milliseconds of the performance of another such step. Thus, when the term "simultaneously" is used in this specification, it refers to steps which are separated in time from each other by no more than about 60 seconds.

The above description is exemplary only, bearing in mind the different types of teeming operation in which the invention may be applied, and the variations in equipment used to perform such operations, and the invention encompasses variations within the scope of the appended claims.

We claim:

1. A method of determining disturbances when discharging molten metal from a metallurgical container having an outlet into a receiving container, said method comprising the steps of:

(a) detecting mechanical vibrations caused by the discharge of molten metal through said outlet;

(b) measuring a second property in addition to said mechanical vibrations, wherein said second property varies during the discharging of said molten metal from said first metallurgical container to said receiving container;

(c) calculating a sensitivity constant based upon said measuring of said second property;

(d) comparing said vibrations detected by said measuring device with a desired vibrational characteristic, wherein said desired vibrational characteristic is defined in part by said sensitivity constant, and wherein said comparing said vibrations is done using a time constant;

(e) analyzing said comparison to determine the existence of said disturbances within said outlet, wherein said detecting of mechanical vibrations, said measuring of said second property, said calculating of said sensitivity constant, and said comparing of said vibrations with a desired vibrational constant, are each conducted within two seconds of each other; and (f) causing said disturbances within said outlet to cease.

2. The method as recited in claim 1, wherein a flow control gate is disposed between said metallurgical container and said receiving container.

3. The method as recited in claim 2, wherein said second property is the position of said flow control gate.

4. The method as recited in claim 1, further comprising the step of acquiring an image of the area in the vicinity of said receiving container.

5. The process as recited in claim 4, wherein said image as analyzed to determine a characteristic of the surface of said molten metal, prior to said step of causing said disturbances within said outlet to cease.

* * * * *